United States Patent [19]

Melikian et al.

[11] 4,342,204

[45] Aug. 3, 1982

[54] ROOM EJECTION UNIT OF CENTRAL AIR-CONDITIONING

[76] Inventors: Zograb A. Melikian; Larisa G. Oganian, both of prospekt Oktemberiana, 29a, kv. 52; Arsen S. Simonian, ulitsa 4 Avan, 3 pereulok, dom 7; Robert T. Kirakosian, Nor-Aresh, 2 ulitsa, 86, all of Erevan, U.S.S.R.

[21] Appl. No.: 98,619

[22] Filed: Nov. 29, 1979

[51] Int. Cl.[3] ..... F28D 5/00

[52] U.S. Cl. ..... 62/304; 98/30; 165/60; 165/19; 261/127

[58] Field of Search ..... 62/304, 171; 236/13; 165/60, 19; 261/127; 98/30

[56] References Cited

U.S. PATENT DOCUMENTS 1,296,968 3/1919 Klein ..... 165/60
3,747,362 7/1973 Mercer ..... 62/171

FOREIGN PATENT DOCUMENTS 238000 5/1964 Austria ..... 165/60
1198035 8/1965 Fed. Rep. of Germany ..... 98/30
2526332 1/1976 Fed. Rep. of Germany ..... 165/60
1357085 2/1964 France ..... 165/60

*Primary Examiner*—Albert J. Makay
*Assistant Examiner*—Henry Bennett
*Attorney, Agent, or Firm*—Robert E. Burns; Emmanuel J. Lobato; Bruce L. Adams

[57] ABSTRACT

A room ejection unit comprises a housing defining a mixing chamber and having side walls, a bottom, and a cover. There is an inlet port in at least one of the housing side walls and an outlet port in the housing cover. A primary air supply manifold with nozzles is arranged in the lower portion of the mixing chamber of the housing. A heat exchanger in the form of a direct-contact apparatus provided with a sprayed packing is installed in the inlet port on the housing side wall. An air humidifier is arranged in the mixing chamber of the housing. The air humidifier has a drip pan disposed in the lower portion of the mixing chamber, sprayers disposed above the heat exchanger and intended for spraying the packing, a pipe which communicates the drip pan with the sprayers, and also a pump installed in the pipe supplying water from the drip pan to the sprayers.

3 Claims, 8 Drawing Figures

ROOM EJECTION UNIT OF CENTRAL AIR-CONDITIONING

BACKGROUND OF THE INVENTION

1. Field of the Invention

The present invention relates to air-conditioning apparatus and is specifically concerned with room ejection units of central air-conditioning systems.

The invention may be most advantageously employed for creating comfortable conditions in hospitals, residential and commercial buildings, as well as for maintaining a normal humidity in refrigerating chambers.

2. Description of the Prior Art

In improving existing and developing new air-conditioning systems numerous attempts have been made to stabilize the indoor air conditions with varying outdoor atmospheric conditions and to reduce at the same time the specific power consumption of air conditioners. Although a great many new designs of air conditioners have been developed over the last 10–15 years, the central air-conditioning systems are the most extensively used ones. They have undergone no radical changes during the last 20 years. This evidences that the above-stated problem remains as yet to be solved adequately enough.

In recent years, there have been observed two different trends in this field: developing an efficient self-contained room air conditioner on the one hand and improving the primary air conditioner and secondary room unit of a central air-conditioning system on the other. Equipping all the rooms in the building with efficient self-contained air conditioners was believed to enable adequately comfortable conditions to be created in all the rooms regardless of their location and of the extent of their being heated due to insolation. Every such self-contained air conditioner should include a complete set of all the means needed for treating air and maintaining desired temperature. Thus, a self-contained air conditioner (cf. USSR Inventor's Certificate No. 151,005 Int. Cl. 2 F 24 F 3/14) comprises a freon compressor, a condenser, an evaporator, a coarse air filter, a heat exchanger, an electric air heater, a humidifier, and a fan, all said units being accommodated in a common housing of the air conditioner. It is clear that to ensure maintaining the predetermined air conditions, with the outdoor conditions varying over a wide range, the power drives and electric units of a self-contained air conditioner must have a considerable power reserve. The advantage of self-contained air conditioners is that their use does not require an air ductwork inside the building. Nevertheless, the self-contained air conditioners have found no wide application for a number of reasons lying in their constructional features and low energy efficiency. Among other things, a complex construction of the self-contained air conditioner results in its relatively high cost and affects its reliability and durability. Installing self-contained air conditioners in every room of a multistorey building raises the total power consumption to such an extent which the existing standard electric wiring cannot provide. In addition, to provide for heat removal from the condenser to the outside, a self-contained air conditioner must be installed in a window aperture, which is not always convenient. Still another disadvantage of the self-contained air conditioners is their large overall dimensions.

Efforts aimed at improving primary air conditioners and room units of central air-conditioning systems have proved to be more promising in this respect. The room units feature a simple construction, occupy little space, and can be located in any convenient place. Moreover, the total amount of power consumed by all the central air-conditioning system units in the building in much less than that which is needed in case all the rooms in the same building are equipped with the self-contained air conditioners. Owing to these and other advantages, central air-conditioning systems have gained an extensive application. A room ejection unit of a central air-conditioning system (cf. "Bacho Induction Units" of the Bacho Ventilation Ltd., Sweden, 1974) comprises a housing whose side walls, bottom, and cover define a mixing chamber. The lower portion of the mixing chamber accommodates a primary air supply manifold. A side wall of the housing has an inlet port wherein a surface heat exchanger is mounted; the heat exchanger is a coil connected to the heat carrier supply system. Such a room unit of the central air-conditioning system is successfully employed both for cooling and heating of air in summer and winter respectively, ensuring a stable temperature in the room. It is to be noted, however, that operation of a system with the above-described room units involves some inconveniences associated with the instability of humidity, which is accounted for by the fact that air supplied from the primary air conditioner to the units in different rooms is of the same humidity. At the same time conditions vary from room to room, and hence the operating conditions of the room units are different. In addition, the conditions in one and the same room vary considerably over a day, and since the air humidity control is a centralized one, it is practically impossible to maintain the optimum humidity in every room.

An attempt has been made to improve the accuracy of controlling humidity in the room by humidification of recirculating air in the room unit (cf. USSR Inventor's Certificate No. 367,318, Int. Cl. 2 F 24 F 3/14). This ejection room unit of a central air-conditioning system comprises a housing whose side walls, bottom, and cover define a mixing chamber. The lower portion of the mixing chamber accommodates a primary air supply manifold having nozzles and communicating with the primary air-conditioner. A side wall of the housing has an inlet port wherein a heat exchanger is mounted. The cover of the housing has an outlet port. The distinctive feature of this unit consists in that it is provided with a humidifier located in the mixing chamber. The humidifier is a water supply pipe arranged in the primary air supply manifold and having branch pipes connected to the nozzles thereof. The heat exchanger is a coil connected to the heat carrier supply system. The primary air supply manifold has the form of a box with nozzles passing through the box top cover. Flowing out of the nozzles, the primary air ejects water from the branch pipes and atomizes it in the mixing chamber, thereby humidifying the recirculating-primary air mixture. This ejection room unit makes possible an individual humidity control in every room. However, practice has shown that this construction is not free from some disadvantages.

One of these disadvantages consists in that the water accumulates on the manifold cover during continuous running of the unit floods the nozzles, and upsets the normal functioning of the humidifier. The water gets ejected from the unit into the room, which prevents an accurate control of the humidity.

Another disadvantage lies in a destabilizing effect exerted on humidifier performance by the coil on which moisture condenses in summer, whereas in winter, when a heated-up heat carrier is fed to the heat exchanger, the relative humidity of air in the room declines due to water evaporation. In addition, the operation of this unit requires a great deal of apparatus and pipes for heating, cooling, and feeding the heat carrier, whose normal functioning requires considerable power.

SUMMARY OF THE INVENTION

The principal object of this invention is to provide a room ejection unit of a central air-conditioning system, wherein the construction of the heat exchanger and that of the humidifier permit the heat-exchange and humidification to be combined.

Another important object of the invention is to provide such a room ejection unit, wherein the destabilizing effect of the heat exchanger on the humidification is minimized.

Still another object of the invention is to provide a more economical room ejection unit of a central air conditioning system.

Yet another object of the invention is to provide such a room ejection unit which requires no special piping to supply and withdraw the heat carrier for operation of the heat exchanger.

A further object of the invention is to improve the accuracy of controlling the air humidity in the room by a room ejection unit of a central air-conditioning system.

An additional object of the invention is to improve the efficiency of ejection in the ejection room unit of a central air-conditioning system.

The above and other objects of the invention are attained in a room ejection unit of a central air-conditioning system, comprising a housing whose upper portion defines a mixing chamber accommodating an air humidifier for humidifying the air ejected through an inlet port provided in a side wall of the housing. A primary air supply manifold is fitted with nozzles for feeding air into the mixing chamber, and a heat exchanger is mounted on the side wall of the housing and adjoining its inlet port. According to the invention, the heat exchanger is a direct-contact apparatus provided with a sprayed packing, and in the lower portion of the body under the mixing chamber is disposed a drip pan communicating through a pump and a pipe with the humidifier having sprayers.

With such a construction of the unit, the heat exchange and humidification processes proceed in the sprayed packing through a direct contact between the atomized water and the recirculating air drawn from the room. This combination of the heat exchange and humidification processes makes it possible to minimize their mutual destabilizing effect, while using the same water both for heat exchange and humidification makes unnecessary heat carrier supply pipes. When the unit runs in the cooling mode, a considerable amount of heat is absorbed by evaporation of water in the sprayed packing. This, along with other above-mentioned factors, results in cutting down the specific power consumption of the room unit and of the central air-conditioning system as a whole, as well as provides a high accuracy of controlling humidity. It should also be noted that in the sprayed packing, moisture droplets wet dust and other particles suspended in the recirculating air, transporting them from the packing into the pan thus cleaning the air. This makes it possible to manage without a mechanical filter, thereby reducing the airflow resistance, and improving the efficiency of ejection.

A modification of the unit is possible wherein the air humidifier pump is of a centrifugal type. Such room units are preferably installed in the rooms remote from the primary air conditioner.

It is expedient that in the room units located nearer to the primary air conditioner, the air humidifier pump be an air-water ejector communicating with the primary air supply manifold and with the pan.

It is advisable to install a mechanical filter at the inlet of the pipe delivering water from the drip pan to the sprayers, which prevents getting of dirt from the drip pan into the sprayers and thereby enhance the reliability of the unit.

It is effective to mount in the primary air supply manifold a throttling damper to vary the flow rate and to selectively shut off the flow of air into the nozzles of said manifold or into the air-water ejector. The presence of said damper will considerably extend the range of controlling the inflowing rate of air.

It is useful to connect to one of the housing side walls at the upper portion of the mixing chamber an outlet pipe brought out of the room and provided with louvers. This allows accumulation of the cold of the outdoor air at night, thereby bringing down the power consumption of the unit and of the system as a whole.

It is expedient to install in the lower portion of the mixing chamber a pressure chamber provided with an underflow wall and a cover, and communicating with the drip pan under said wall, and with the primary air supply manifold through a pipe mounted into the cover. With such a construction of the unit the water level in the drip pan is maintained constant, which provides for the most stable operation of the pump.

To remove dirt settled in the drip pan, it is advisable to connect to the drip pan a drain pipe passed through the housing bottom and provided with a shut-off valve.

It is useful that the sprayed packing be installed so that it covers a portion of the inlet port and that another portion of the inlet port be provided with louvers. This enables a better control of the primary-recirculating air mixture (the inflowing air).

BRIEF DESCRIPTION OF THE DRAWINGS

The invention will now be explained by description of particular embodiments thereof with reference to the accompanying drawings, in which.

DESCRIPTION OF THE PREFERRED EMBODIMENTS

Figure 1:
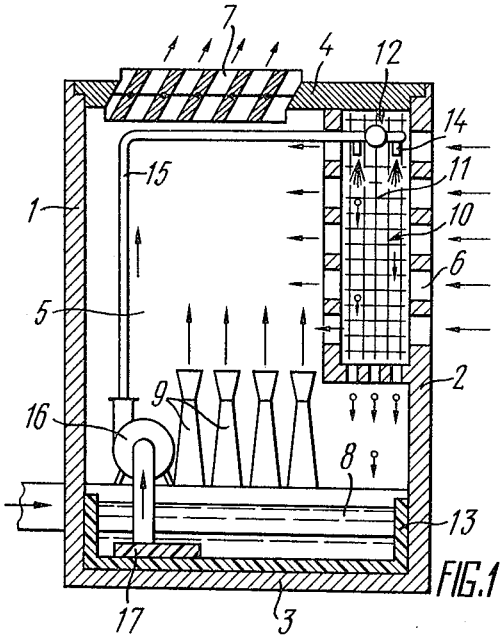
FIG. 1 is an elevational view showing the general arrangement of a room ejection unit of a central air-conditioning system.

Referring to FIG. 1 of the accompanying drawings, a room ejection unit of a central air-conditioning system comprises a hollow heat and sound-insulated housing 1 whose side walls 2, bottom 3, and cover 4 define a mixing chamber 5 in the upper portion thereof. The side wall 2 of the housing 1 has an inlet port 6 for letting in recirculating air from the room into the mixing chamber 5. The cover 4 of the housing 1 has an outlet port 7 for letting out a humidified primary-recirculating air mixture into the room. The lower portion of the mixing chamber 5 accommodates a primary air supply manifold 8 having nozzles 9. On the side wall 2 of the housing 1 in the inlet port 6 there is mounted a heat exchanger 10 which, according to the invention, is a direct-contact apparatus with a sprayed packing 11. An air humidifier 12 is arranged in the mixing chamber 5. According to the invention, the air humidifier 12 has a drip pan 13 disposed in the lower portion of the housing 1 under the mixing chamber 5 and sprayers 14 disposed above the heat exchanger 10 and intended for spraying the packing 11. The drip pan 13 communicates with the sprayers 14 through a pipe 15 wherein a pump 16 to supply water from the drip pan 13 to the sprayers 14 is installed. The pump 16 is of a centrifugal type. Also, according to the invention, a mechanical filter 17 is installed at the inlet of the pipe 15 supplying water from the drip pan 13 to the sprayers 14.

Figure 2:
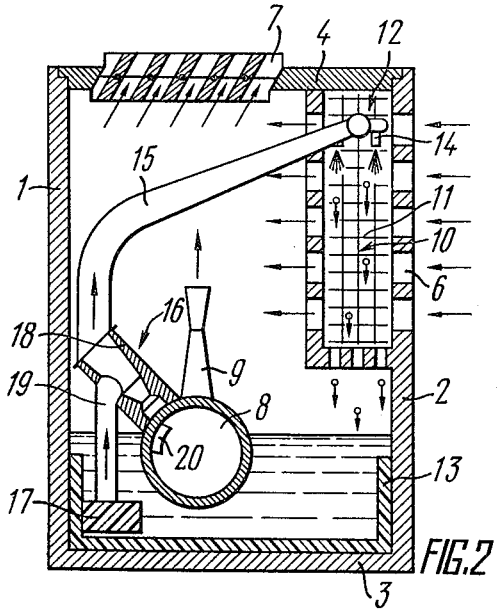
FIG. 2 is an elevational view of a modification of the room ejection unit with the pump in the form of an air-water ejector.

FIG. 2 of the accompanying drawings shown a modification of the room ejection unit, wherein, according to the invention, the pump 16 of the air humidifier 12 is an air-water ejector 18 communicating with the drip pan 13 through a connecting pipe 19. In this modification, the mechanical filter 17 is installed at the inlet of said pipe 19.

Figure 3:
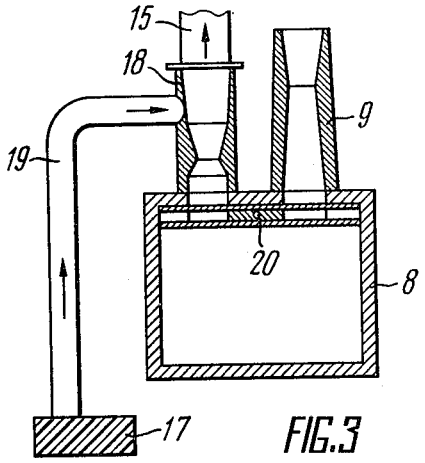
FIG. 3 shows in cross-section a primary air supply manifold with a throttling damper.

Also, in this modification, the primary air supply manifold, according to the invention, is provided with a throttling damper 20 to vary the flow rate and to selectively shut off the air flow into the nozzles 9 of the manifold 8 or into the air-water ejector 18. As will be seen from FIG. 3 of the accompanying drawings, the throttling damper 20 is mounted inside the manifold 8.

Figure 4:
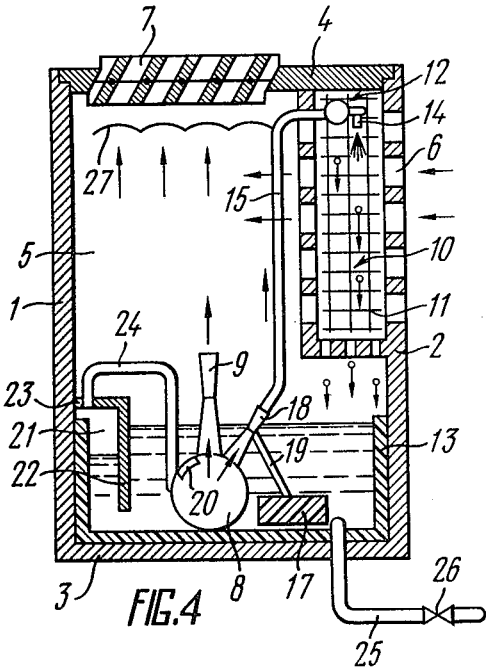
FIG. 4 is an elevational view of a modification of the room ejection unit with a pressure chamber.

FIG. 4 of the accompanying drawings shows a modification of the room ejection unit incorporating, according to the invention, a pressure chamber 21 installed in the lower portion of the mixing chamber 5. The pressure chamber 21 has an underflow wall 22 and a cover 23, and communicates with the pan 13 under said underflow wall 22, and with the primary air supply manifold 8, through a pipe 24 mounted into said cover 23. Also, in this modification of the ejection room unit, according to the invention, a drain pipe 25 passed through the bottom 3 of the housing 1 and provided with a shut-off valve 26 is connected to the pan 13. An electric heater 27 for additional heating of humidified primary-recirculating air mixture in winter is arranged in the upper portion of the mixing chamber 5.

Figure 5:
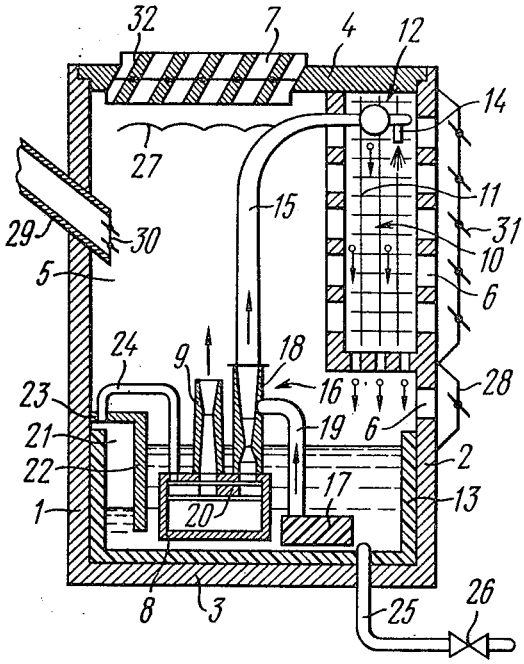
FIG. 5 is an elevational view of a modification of the room ejection unit with a outlet pipe connected to one of the side walls of the housing.

FIG. 5 of the accompanying drawings shows a modification of the room ejection unit wherein, according to the invention, the sprayed packing 11 is installed so that it covers a portion of the inlet port 6, whereas the another portion of the inlet port 6 is provided with louvers 28. The best results are attained when the sprayed packing 11 covers the upper portion of the inlet port 6. Also, in this modification of the room ejection unit, according to the invention, an outlet pipe 29 led out of the room and provided with louvers 30 is connected to one of the side walls 2 of the housing 1 at the upper portion of the mixing chamber 5. The best results are attained when said outlet pipe 29 is connected to that side wall 2 of the housing 1, which is opposite to the side wall 2 of the housing 1, wherein the inlet port 6 is disposed. In this modification, the inlet port 6 is provided with louvers 31, and the outlet port 7, with louvers 32.

Figure 6:
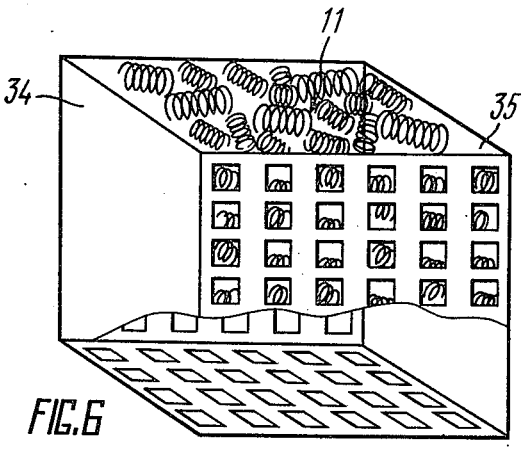
FIG. 6 is a perspective view of a modification of the direct-contact apparatus with a water-absorbing sprayed packing.
Figure 7:
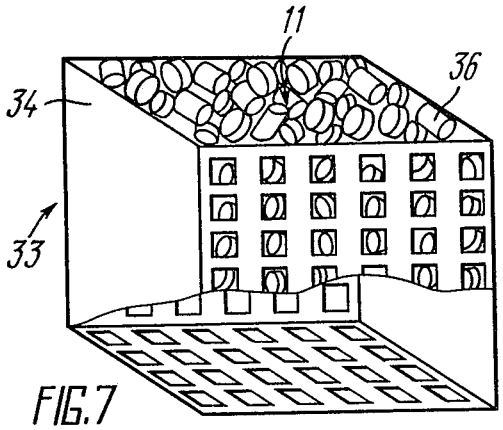
FIG. 7 is a perspective view of a modification of the direct-contact apparatus with a sprayed packing of ceramic rings.
Figure 8:
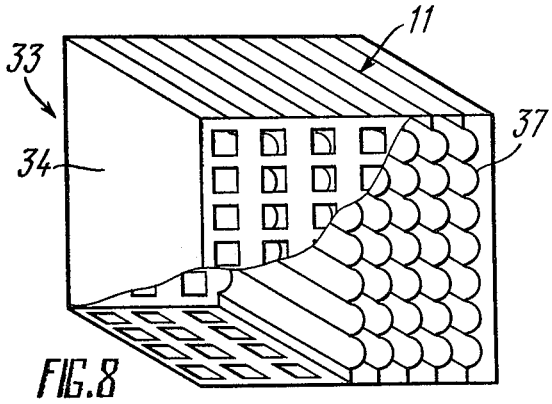
FIG. 8 is a perspective view of a modification of the direct-contact apparatus with a sprayed packing of corrugated strips.

FIGS. 6, 7, and 8 of the accompanying drawings illustrate different modifications of the direct-contact apparatus having the sprayed packing 11 wherein heat exchange and humidification of the recirculating air passing from the room into the ejection room unit take place.

FIG. 6 of the accompanying drawings shows a modification of the direct-contact apparatus comprising a holder 33 with latticed walls 34, whose inner space accommodates the sprayed packing 11 which is a water-absorbing one made of wooden shavings 35.

FIG. 7 of the accompanying drawings shows a modification of the direct-contact apparatus comprising the sprayed packing 11 in the form of ceramic rings 36 accommodated in the inner space of the holder 33.

FIG. 8 of the accompanying drawings shows a modification of the direct-contact apparatus comprising the sprayed packing 11 in the form of corrugated strips 37 aranged vertically in the holder 33 and forming sinuous channels.

During the operation of the room ejection unit of a central air-conditioning system, the primary air pretreated in the primary air conditioner (not shown in the drawings) passes into the manifold 8 wherefrom it is delivered through the nozzles 9 at a high velocity into the mixing chamber 5.

In summer, the primary air delivered into the mixing chamber 5 is pre-cooled, and in winter, pre-heated.

A high velocity of the supplied air creates a negative pressure in the mixing chamber 5, which promotes suction of the recirculating air from the room through the inlet port 6 into the mixing chamber 5. Simultaneously with the primary air supply, the air humidifier 12 is turned on, and water from the drip pan 13 is supplied by the centrifugal pump 16 through the filter 17 and piping 15 to the sprayers 14 where it is atomized and sprays the packing 11 of the heat exchanger 10. Passing via the inlet port 6 into the mixing chamber 5, recirculating air flows through the latticed wall 34 of the holder 33 of the direct-contact apparatus and the sprayed packing 11 wherein it comes into contact with water drops and with the moistened material of the packing 11, thereby being humidified and cooled. Concurrently with being humidified and cooled, recirculating air is cleaned of particles suspended therein, which particles jointly with water drops flow down into the drip pan 13. Having been treated in this manner, recirculating air is mixed in the mixing chamber with primary air supplied thereto, therey producing conditioned air which passes into the room through the outlet port 7. Water, passing through the packing 11 of the direct-contact apparatus and partly evaporating, flows down into the drip pan 13. When the water-absorbing wooden shavings 35 are used for the sprayed packing 11, water flows downward through sinuous pathways, formed by the wooden shavings 35. In the same manner the sprayed water flows through the sinuous pathways in the sprayed packing 11 formed by the ceramic rings 36 or by the corrugated strips 37.

When the pump 16 is the air-water ejector 18, a portion of treated primary air flows at a high velocity through the nozzles 9 into the mixing chamber 5 where a negative pressure is thus created, while the other portion of the primary air flows into the air-water ejector 18, with the result that water is ejected from the drip pan 13 through the filter 17 and the pipe 19. The air-water mixture thus formed passes through the pipe 15 to the sprayers 14. The flow rate of the incoming primary air through the nozzles 9 and the air-water ejector 18 is controlled by means of the throttling damper 20. Further operation of the ejection room unit proceeds in the same way as described above.

In modification shown in FIG. 4 of the accompanying drawings, a portion of the primary air passes from the manifold 8 via the pipe 24 into the pressure chamber 21. Under the pressure of air the water is forced from the pressure chamber 21 under the underflow wall 22 into the pan 13. As a result, the water level in the drip pan 13 rises, thus enabling the inflow of water by gravity into the air-water ejector 18. The water level in the pan 13 is controlled by varying the pressure of the primary air.

Dirty water is periodically removed from the drip pan 13 through the drain pipe 25, after which the pan is filled with clean water.

Further operation of the room ejection unit proceeds in the same way as described above. In winter, the inflowing air is additionally heated by the electric heater 27, after which it flows through the outlet port 7 into the air-conditioned room.

In the modification shown in FIG. 5 of the accompanying drawings, the recirculating air drawn into the mixing chamber 5 is divided into two flows. The first flow is drawn through the upper portion of the inlet window 6 and passes through the sprayed packing 11, wherein it is humidified and cooled, while the second flow is drawn through the lower portion of the inlet port 6. This enables the final conditioning of the inflowing air to be controlled most efficiently.

This modification of the ejection room unit makes it possible at night to accumulate cold in the cooled water in the drip pan 13, since no cold is consumed by the air-conditioned room at this time. To accomplish this, the louvers 28 and 31 of the inlet port and the louvers 32 of the outlet port 7 are closed, and the louvers 30 of the outlet pipe 29 are opened; the nozzles 9 of the primary air supply manifold 8 are at the same time closed by the throttling damper 20. Outdoor primary air without being heated and hence having a relatively low temperature is supplied from the primary air conditioner (not shown in the drawing) into the manifold 8. Primary air passes through the air-water ejector 18 and takes the water from the drip pan 13 into the heat exchanger 10. As a result of heat exchange in the air-water ejector 18 and in the heat exchanger 10, water is cooled to the temperature of the wet-bulb thermometer of night air. The cooled water passes through the sprayed packing 11 and flows down into the drip pan 13, whereas the air separated from water is passed through the outlet pipe 29 to the outside.

In the day-time, the louvers 30 of the duct 29 are closed, and the louvers 28 and 31 of the inlet port 6 and the louvers 32 of the outlet port 7 are opened; at the same time, the nozzles 9 are opened by shifting the throttling damper 20. The progressively rising consumption of cold by the air-conditioned room is met at the expense of the cold accumulated in water. In this case the air cooler of the primary air conditioner (not shown in the drawing) is cut off. Operation time of ejection room unit under such operating conditions depends on the capacity of the pan 13.

At the beginning of the peak cold consumption, the air cooler of the primary air conditioner is turned on and primary air is cooled by refrigeration.

Further operation of the ejection room unit proceeds in the same way as described above.

While only some particular embodiments of the invention have been shown and described, various modifications thereof may be made without departing from the spirit and scope of the invention as defined in the claims.

What is claimed is:

1. A room ejection unit of a central air-conditioning system comprising, a housing defining a mixing chamber and having an inlet port communicating with said mixing chamber for communicating with the exterior and an outlet port above the mixing chamber in communication therewith; a heat exchanger installed in said housing adjacent the inlet port and constructed as a direct-contact apparatus with a sprayed packing; an air humidifier in the housing adjacent the inlet port having sprayers for spraying water on said packing, a drip pan below the sprayed packing for receiving water from the sprayers dripping from the sprayed packing, a pump drawing water from the drip pan and providing it to said sprayers, a primary air supply manifold having nozzles arranged in a lower part of the mixing chamber for delivery of primary air into an upper part of the mixing chamber for mixing with a flow of air from said heat exchanger and humidifier in a direction toward the outlet port, and said pump comprising an air-water ejector communicating with said primary air supply manifold and said pan.

2. A room ejection unit of a central air-conditioning system according to claim 1, including damper means in said manifold for varying flow rate of primary air to said nozzles and for selectively shutting off supply of primary air to said nozzles or into the air-water ejector pump.

3. A room ejection unit of a central air-conditioning system comprising, a housing defining a mixing chamber and having an inlet port communicating with said mixing chamber for communicating with the exterior and an outlet port above the mixing chamber in communication therewith; a heat exchanger installed in said housing adjacent the inlet port and constructed as a direct-contact apparatus with a sprayed packing; an air humidifier in the housing adjacent the inlet port having sprayers for spraying water on said packing, a drip pan below the sprayed packing for receiving water from the sprayers dripping from the sprayed packing, a pump drawing water from the drip pan and providing it to said sprayers, a primary air supply manifold having nozzles arranged in a lower part of the mixing chamber for delivery of air into an upper part of the mixing chamber for mixing with a flow of air from said heat exchanger and humidifier in a direction toward the outlet port; a pressure chamber installed in the lower portion of the mixing chamber and having an underflow wall extending into the drip pan and a cover, and a pipe providing communication for said pressure chamber with said drip pan under said cover and said underflow wall and said primary air supply manifold for inducing air under pressure in said pressure chamber to raise the level of water in the drip pan to a desired level for said pump.

* * * * *